US007090016B2

(12) United States Patent
Lee et al.

(10) Patent No.: US 7,090,016 B2
(45) Date of Patent: Aug. 15, 2006

(54) WELL HAVING INHIBITED MICROBIAL GROWTH

(75) Inventors: Brady D. Lee, Idaho Falls, ID (US); Kirk J. Dooley, Shelley, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 10/949,109

(22) Filed: Sep. 23, 2004

(65) Prior Publication Data

US 2005/0034855 A1 Feb. 17, 2005

Related U.S. Application Data

(62) Division of application No. 09/991,331, filed on Nov. 14, 2001, now Pat. No. 6,810,957.

(51) Int. Cl.
*E21B 43/02* (2006.01)

(52) U.S. Cl. ..... 166/279; 210/170

(58) Field of Classification Search ..... 166/246, 166/244.1, 276, 248, 279, 902, 245; 424/405
See application file for complete search history.

(56) References Cited

U.S. PATENT DOCUMENTS 3,202,213 A 8/1965 Howard
3,489,218 A * 1/1970 Means ..... 166/279
3,547,194 A 12/1970 Morine
3,566,970 A 3/1971 Crow et al.
3,940,430 A 2/1976 Brenner et al.
4,022,909 A * 5/1977 Hunsucker ..... 514/552
4,670,166 A 6/1987 McDougall et al.
5,016,714 A * 5/1991 McCabe et al. ..... 166/308.1
5,099,917 A * 3/1992 Roser ..... 166/51
5,128,051 A 7/1992 Theis et al.
5,481,927 A 1/1996 Hubbell et al.
5,690,173 A 11/1997 Abdul et al.
6,244,346 B1 6/2001 Perriello

FOREIGN PATENT DOCUMENTS

JP 408119802 A * 5/1996

* cited by examiner

*Primary Examiner*—John Kreck
(74) *Attorney, Agent, or Firm*—Wells St. John P.S.

(57) ABSTRACT

The invention includes methods of inhibiting microbial growth in a well. A packing material containing a mixture of a first material and an antimicrobial agent is provided to at least partially fill a well bore. One or more access tubes are provided in an annular space around a casing within the well bore. The access tubes have a first terminal opening located at or above a ground surface and have a length that extends from the first terminal opening at least part of the depth of the well bore. The access tubes have a second terminal opening located within the well bore. An antimicrobial material is supplied into the well bore through the first terminal opening of the access tubes. The invention also includes well constructs.

15 Claims, 1 Drawing Sheet

WELL HAVING INHIBITED MICROBIAL GROWTH

RELATED APPLICATIONS

This application is a divisional of U.S. patent application Ser. No. 09/991,331, filed on Nov. 14, 2001 now U.S. Pat. No. 6,810,957.

CONTRACTUAL ORIGIN OF THE INVENTION

This invention was made with United States Government support under Contract No. DE-AC07-99ID13727 awarded by the United States Department of Energy. The United States Government has certain rights in the invention.

TECHNICAL FIELD

The present invention pertains to well constructions and methods of inhibiting microbial growth in wells.

BACKGROUND OF THE INVENTION

The presence of microbial growth can cause bio-fouling and plugging of wells. Such plugging can occur both in vadose-zone wells and in saturated-zone wells. Vadose-zone wells are wells having a well bore that does not extend into the water table, and include, for example, vadose-zone monitoring wells, vapor extraction wells and injection wells. Saturated-zone wells have a well bore that extends into the water table such as, for example, ground water monitoring wells, production wells and irrigation wells. Plugging of a well may occur by plugging of structures within the well such as the filter pack, screening, piping, or pumps. Plugging may also occur by the plugging of the surrounding geological media. Such plugging is caused by an accumulation of microbial growth, by an accumulation of microbial extracellular material, or both.

Once a well has become bio-fouled or plugged, treatment of the well to eliminate microbial growth and remove plugging is often difficult and ineffective. Remedial chemical treatments, such as an introduction of a highly concentrated chlorine solution into the well, often fail due to the difficulty in forcing the solution through an already plugged well. Once bio-fouling has occurred, replacement of the effected structure is often required. Severe bio-fouling and plugging may require replacement of the entire well at great expense.

Accordingly, it is desirable to provide well constructions and preventative treatment methods designed to minimize unwanted microbial growth in wells.

SUMMARY OF THE INVENTION

In one aspect, the invention encompasses a method of inhibiting microbial growth in a well. A well bore is provided. A first material is mixed with an antimicrobial agent to form a packing material. The packing material is used to fill at least a portion of the well bore.

In another aspect, the invention encompasses a material for packing within a well. The material for packing the well includes either sand or gravel, or both. The material for packing the well also includes an antimicrobial agent. The antimicrobial agent can be in powdered form, in granular form, in pellet form, in tablet form, in precipitate form, or can be a mixture of two or more of these forms.

In another aspect, the invention encompasses an additional method of inhibiting microbial growth in a well. A well bore is provided that has a depth extending from a ground surface. A casing is provided within the well bore and is at least partially surrounded by an annular space. One or more access tubes are provided within the annular space of the well bore, outside the casing. The access tubes have a first terminal opening located at or above the ground surface and have a length that extends from the first terminal opening at least part of the depth of the well bore. The access tubes have a second terminal opening located within the well bore. An antimicrobial material is supplied into the well bore through the first terminal opening of the access tubes.

In still another aspect, the invention encompasses a well construction having inhibited microbial growth. The well construction includes a well bore and a well casing within the well bore. The casing has a terminal end within the well bore and has a screened portion that extends from the terminal end to a first elevation within the well bore. Multiple access tubes encircle the casing within the well bore. The access tubes have a terminal end within the bore and have a perforated segment extending from the terminal end to a second elevation within the well bore. The well bore contains a layer of packing material comprising a first antimicrobial agent mixed with either sand or gravel, or mixed with both sand and gravel. The layer of packing material fills the well bore to a third elevation. The well construction includes a second antimicrobial agent which, when provided through an access tube, is able to pass from within an access tube into the packing material through the perforated segment of the access tube.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
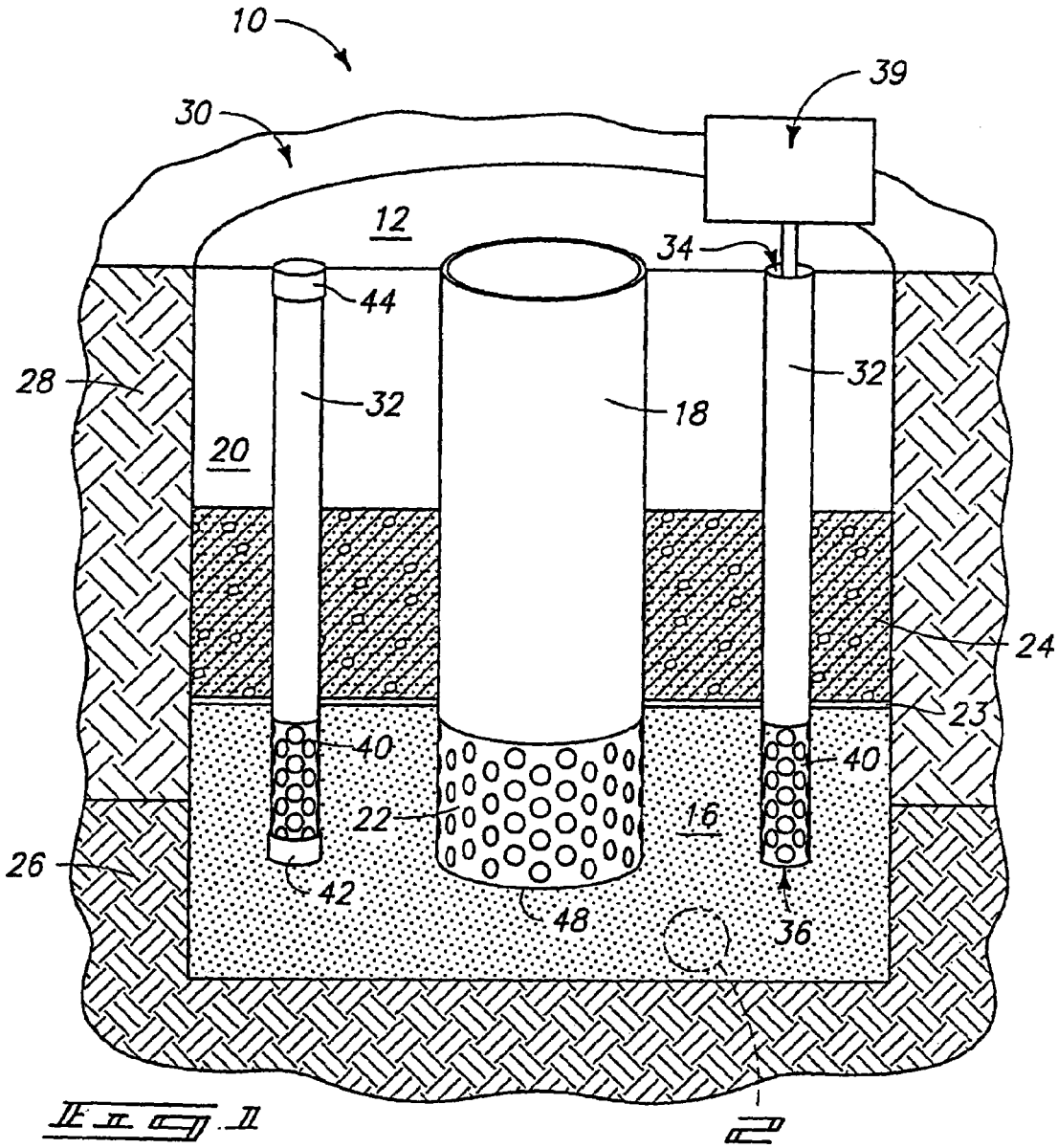
FIG. 1 shows a diagram of a well construction formed in accordance with the methodology of the present invention.
Figure 2:
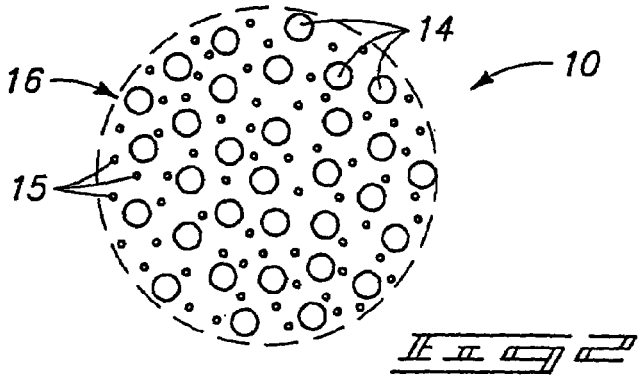
FIG. 2 is an enlarged view of the encircled region in FIG. 1.

The present invention is described with reference to a well construction 10 in FIGS. 1 and 2. Referring to FIG. 1, well construction 10 comprises a well bore 12. A packing material 16 at least partially fills well bore 12. Packing material 16 comprises a first material 14 and an antimicrobial agent 15, as shown in FIG. 2. Prior to use in the well bore, packing material 16 can be formed by mixing first material 14 with antimicrobial agent 15.

A variety of materials are available for use as first material 14 for purposes of the present invention. Exemplary materials include sand, gravel, or a mixture thereof.

Antimicrobial agent 15 can comprise a solid and can be mixed with first material 14 such that packing material 16 contains antimicrobial agent 15 from about 0.5% to about 30% (by volume). Exemplary solid forms for antimicrobial agent 15 for purposes of the present invention include precipitate form, powder form, tablet form, granular form or pellet form.

Mixing of antimicrobial agent 15 with first material 14 can comprise coating the first material with the antimicrobial agent. Coating of first material 14 can be performed by mixing a powdered antimicrobial agent with the first material. Coating can also be performed by dissolving any of the solid forms of antimicrobial agent, mixing the dissolved antimicrobial agent with the first material, and re-precipitating the antimicrobial agent. The solid antimicrobial agents can be dissolved in an organic or an inorganic solvent based upon the solubility properties of the specific agent. The resulting precipitate can form a coating on first material 14. Alternatively, the mixing can comprise forming a composite mixture of the first material and one or more of, for example, antimicrobial powder, antimicrobial tablets, antimicrobial granules, and antimicrobial pellets.

At least some of the antimicrobial agent 15 utilized for purposes of the present invention can be delayed release. A delayed release antimicrobial agent can include, for instance, solid forms of an antimicrobial agent that dissolve slowly in water. For example, a tablet form, a granular form or a pellet form of antimicrobial compound can dissolve more slowly than the powder form of the same antimicrobial compound. In addition, encapsulation or coating of any of the solid forms listed can further decrease the rate of dissolving in water. Numerous encapsulating or coating material is available for utilization in the present invention, including coating material comprising, for instance; proteins, polysaccharide, starches, waxes, fats, natural and synthetic polymers, and resins.

Numerous compounds from a variety of classes of antimicrobial compounds of can be utilized for purposes of the present invention. Exemplary classes of such antimicrobial compounds include chlorine release type compounds, antimicrobial amines, and antimicrobial metals. Chlorine release type compounds include, for instance, compounds that can release chlorine when the compound reacts with water. Specific chlorine release compounds include, for example, calcium hypochlorites, trichloroisocyanurate, dichloroisocyanurate.

Specific types of compounds within the class of antimicrobial amines for purposes of the present invention include, quaternary ammonia compounds and N-halamines such as; poly-acrylonitrile-co-4(acryloxymethyl)-4-ethyl-2-oxazolidinone latex, poly-vinyl chloride-co-4-(acryloxymethyl)-4-ethyl-2-oxazolidinone latex, poly-styrene-co-4-(acryloxymethyl)-4-ethyl-2-oxazolidinone latex, poly-vinyl acetate-co-4-(acryloxymethyl)-4-ethyl-2-oxazolidinone latex, poly-acrylonitrile-g-4-(acryloxymethyl)-4-ethyl-2-oxazolidinone latex, poly-vinyl chloride-g-4-(acryloxymethyl)-4-ethyl-2-oxazolidinone latex, poly-styrene-g-4-(acryloxymethyl)-4-ethyl-2-oxazolidinone latex, poly-vinyl acetate-g-4-(acryloxymethyl)-4-ethyl-2-oxazolidinone latex, poly-vinyl alcohol-g-4-(acryloxymethyl)-4-ethyl-2-oxazolidinone latex and poly(1,3,5-trichloro-6-methyl-6-(4'-vinylphenyl)-1,3,5-triazine-2,4-dione.

Specific examples of agents within the class of antimicrobial metals which can be utilized for purposes of the present invention include, but are not limited to, silver, zinc and copper.

The present invention encompasses embodiments of packing material 16 wherein the packing material comprises a single solid form of antimicrobial agent and embodiments wherein packing material 16 comprises multiple solid forms of an antimicrobial agent. In addition, packing material 16 can comprise a single antimicrobial compound or can comprise multiple antimicrobial compounds from one or more of the classes of compounds listed. It can be beneficial to have multiple forms of solid antimicrobial present in packing material 16 to provide both short term and long term microbial growth inhibition. For example, if antimicrobial agent 15 comprises both a powder form and a tablet form, the powder form can dissolve quickly, thereby providing an immediate microbial growth inhibiting effect, while the tablet form can dissolve more slowly, providing a delayed or long term effect relative to the powder form. For similar reasons, it can be beneficial for antimicrobial agent 15 to comprise multiple compounds or classes of compounds which dissolve at different rates or vary in duration of microbial inhibiting effects.

The well construction 10 of the present invention can comprise a vadose-zone well or a saturated-zone well. Well bore 12 can, therefore, comprise a depth that extends from a ground surface 30 into the vadose-zone 28 (not shown), or, as shown in FIG. 1., from ground surface 30 into the saturated-zone 26. Where the well is a vadose-zone well, because the bore does not extend into the water table, water for reacting with or dissolving an antimicrobial agent is provided by for example, condensation, infiltration, or unsaturated flow. The rate of dissolving of any given form of an antimicrobial agent, therefore, will be less than the corresponding rate in a saturated-zone well. The form of solid to be utilized in a specific well construction can be determined accordingly.

In the shown embodiment, well construction 10 comprises a casing 18 within well bore 12. It is to be understood that the present invention encompasses an open-bore well construction that lacks casing 18 (not shown). Casing 18 can be at least partially surrounded by an annular space 20 and can comprise a screened portion 22 that extends from a terminal end 48, located within well bore 12, to a first elevation within the well bore. Packing material 16 can fill at least part of annular space 20 around well casing 18 to a second elevation within the well bore. The second elevation can be greater than the first elevation such that packing material 16 at least covers screened portion 22 of casing 18.

Additionally, well construction 10 can comprise a seal layer 23 which can seal packing material 16. Seal layer 23 can comprise, for example, bentonite, concrete, neat cement, or a mixture thereof. Whether or not well construction 10 comprises seal layer 23, well construction 10 can comprise a fill material 24 such as, for instance, concrete, bentonite (in dry form or comprised in a slurry), neat cement, or a mixture of cement and bentonite. Fill material 24 can at least partially fill any annular space 20 remaining in the well bore beyond the portion filled with packing material 16.

In addition to the features described above, the invention encompasses a well construction 10 comprising at least one access tube 32 within well bore 12. In embodiments comprising well casing 18, the at least one access tube can be positioned outside casing 18 within annular space 20. Access tubes 32 have a first terminal opening 34 that is preferably located above ground surface 30. Access tubes 32 extend at least part of the depth of well bore 12, from first terminal opening 34, to a second terminal opening 36 within the well bore. Well construction 10 can comprise an antimicrobial agent 39 that is distinct from the antimicrobial agent 15 in packing material 16, at least initially.

Access tubes 32 are not limited to a specific number of tubes, nor is placement of such tubes limited to a specific distribution within well bore 12. The number of tubes can be, for instance, from about 2 to about 10 access tubes. Access tubes 32 can have a diameter from about 0.25 inches to about 1.5 inches. The access tubes can be distributed, for example, around the circumference of casing 18 and can be equally spaced around the circumference with respect to each other.

In addition to the above features, access tubes 32 of well construction 10 can comprise a perforated segment 40 extending from second terminal opening 36 to a third elevation within well bore 12. The third elevation can be less than the second such that perforated segment 40 is entirely covered by packing material 16. Access tubes 32 can comprise a cap 42 to close second terminal opening 36, and a removable cap 44 that covers first terminal opening 34.

Antimicrobial material 39 can be supplied into well 10 through the first terminal opening 34 of access tubes 32. Once antimicrobial agent 39 is added through terminal opening 34, antimicrobial agent 39 can be able to pass from within access tube 32 into packing material 16 through perforated segment 40 of access tube 32.

Antimicrobial material 39 can be supplied at time intervals. Exemplary time intervals for purposes of the present invention can be from between about 2 months and about 12 months. During the time interval between supplying antimicrobial agent 39, the first terminal opening 34 of access tubes 32 can be reversibly capped 44.

Antimicrobial agent 39 is not limited to any specific material or form. Antimicrobial agent 39 can comprise, for example, one or more of the solid forms discussed above with respect to antimicrobial agent 15. Antimicrobial agent 39 can also comprise one or both of a gas antimicrobial agent and a liquid antimicrobial agent, or can comprise a combination of one or more of a gas antimicrobial agent, a liquid antimicrobial agent and a solid antimicrobial agent. Exemplary gas antimicrobial agents for purposes of the present invention include chlorine and ozone. Exemplary liquid antimicrobial agents, for purposes of the present invention include one or more of iodine, bromine or a dissolved form of any of the chlorine release type compound discussed above.

Where antimicrobial agent 39 comprises a gas or a liquid, supplying of antimicrobial agent 39 through first terminal opening 34 can comprise pressure pumping the gas or liquid through first terminal opening 34. Alternatively, the gas or liquid may be pushed through the access tube by utilizing a pressurized air stream that can be flowed through first terminal opening 34 of access tubes 32, or by inserting a slotted tube through the first terminal opening to sift the antimicrobial agent through perforated segment 40 of the access tubes.

As shown in FIG. 1, well constructions 10 encompassed by the present invention include constructions comprising the described well packing material 16 containing antimicrobial agent 15, and simultaneously comprising access tubes 32 and the described antimicrobial agent 39, in a single well. Where a single well comprises both antimicrobial agent 15 and antimicrobial agent 39, the two antimicrobial agents can be the same or can differ. As discussed above, it can be beneficial to provide a multiple forms of antimicrobial compounds and/or multiple compounds within a single well.

Well constructions encompassed by the present invention also include constructions comprising access tubes 32 and antimicrobial agent 39 in the absence of packing material 16 and antimicrobial 15 (not shown). The invention also contemplates well constructions comprising packing material 16 containing antimicrobial agent 15, and comprising an absence of antimicrobial agent 39, and well constructions comprising packing material 16 and an absence of access tubes 32. The use of packing material 16 of the present invention is not intended to be limited to use within a well.

It is to be understood that the present invention contemplates adaptation of the above described methods and well constructs for bio-remedial and bio-venting wells. Bio-venting and bio-remedial wells utilize bacteria to perform functions in furtherance of the purposes of the well. However, growth of these microbes is preferentially constrained to the surrounding geological structures rather than within the well bore. Accumulation of such microbes or extracellular material within the well bore can detrimentally effect the functioning of the well, and lead to plugging.

The above described methods can be used to inhibit microbial growth within the well bore of a bio-venting or bio-remedial with limited adverse effects on the microbial population in the surrounding geological structures. For example, an antimicrobial with limited diffusion properties due to a low solubility, such as for instance a polymeric amine, can be utilized within the well bore to minimize diffusion into the surrounding geological structures. The antimicrobial effects can thereby be limited to, or localized within, the well bore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A well comprising:

a well bore extending only partially through the vadose-zone;

a layer of packing material within the well bore, wherein the layer of packing material comprises a mixture of an antimicrobial agent and one or more of sand and gravel, the mixture having an antimicrobial agent content of from about 0.5% to about 30%, by volume;

a casing within the well bore, wherein the casing comprises a screened portion; and an annular space around at least part of the casing, wherein the layer of packing material within the bore is within the annular space and at least partially covers the screened portion of the casing.

2. The well of claim 1 wherein the layer of packing material entirely covers the screened portion of the casing.

3. A well comprising:

a well bore;

one or more access tubes within the well bore;

a well casing, and wherein the one or more access tubes encircle the casing and are spaced equally with respect to each other; and an antimicrobial agent within the well bore, the antimicrobial agent being added though the access tubes, at least some of the antimicrobial agent being in an encapsulated powder form or an encapsulated granular form.

4. The well of claim 3 wherein the antimicrobial agent comprises one or both of a liquid and a gas.

5. The well of claim 3 wherein the one or more access tubes have a diameter of from about 0.25 inches to about 1.5 inches.

6. The well of claim 3 wherein the antimicrobial agent comprises a first antimicrobial agent and wherein the well construction further comprises a layer of packing material within the well bore, the layer of packing material comprising a second antimicrobial agent.

7. The well of claim 6 wherein the second antimicrobial agent is different from the first antimicrobial agent.

8. The well of claim 3 wherein the well bore extends into the saturated-zone.

9. The well of claim 3 wherein the well bore extend into the vadose-zone.

10. A well having inhibited microbial growth comprising:

a well bore;

a well casing within the well bore, the casing having a terminal end within the well bore and having a screened portion extending from the terminal end to a first elevation within the bore;

multiple access tubes, the access tubes being within the well bore and encircling the casing, the access tubes having a first terminal opening and a second terminal opening, the second terminal opening being within the well bore, and having a perforated segment extending from the second terminal opening to a second elevation within the well bore;

a layer of packing material within the well bore, wherein the packing layer comprises a mixture of a first antimicrobial agent and one or more of sand and gravel and fills the bore to a third elevation within the bore and wherein the mixture was mixed prior to formation of the layer; and a second antimicrobial agent within the access tubes, the second agent being able to pass from within the access tubes into the layer of packing material through the perforated segment of the access tubes.

11. The well of claim 10 wherein the third elevation is greater than the first and the second elevation.

12. The well of claim 10 wherein the second antimicrobial is added through the first terminal opening, and wherein the second antimicrobial comprises one or both of a gas and a liquid.

13. The well of claim 12 wherein the one or both of a gas and a liquid are pumped through the first terminal opening of the access tubes.

14. The well of claim 12 wherein the one or both of a gas and a liquid are pushed through the access tubes and into the layer of packing material by a pressurized air stream flowed through the first terminal opening of the access tubes.

15. The well of claim 12 wherein the one or both of a gas and a liquid are pushed through the access tubes and into the layer of packing material by inserting a slotted tube through the first terminal opening of the access tubes to sift the antimicrobial agent through the perforated segment of the access tubes.

* * * * *